United States Patent [19]

Frenzel et al.

[11] 4,444,106

[45] Apr. 24, 1984

[54] ARRANGEMENT FOR SELECTIVELY CONNECTING COAXIAL GEAR WHEELS OF A GEAR TRAIN OF A DUAL MODE PRINTING MACHINE

[75] Inventors: Werner Frenzel, Radebeul; Johannes Naumann, Coswig; Otfried Rudolph, Dresden; Gunter Peter; Karlheinz Fischer, both of Coswig; Alfred Schott, Radebeul; Hans-Jürgen Tappert, Coswig, all of German Democratic Rep.

[73] Assignee: Veb Kombinat Polygraph "Werner Lamberz" Leipzig, Leipzig, German Democratic Rep.

[21] Appl. No.: 355,537

[22] Filed: Mar. 8, 1982

Related U.S. Application Data

[63] Continuation-in-part of Ser. No. 330,773, Dec. 14, 1981, abandoned.

[51] Int. Cl.[3] ..... B41F 5/06; B41F 13/00

[52] U.S. Cl. ..... 101/183; 101/230

[58] Field of Search ..... 101/230, 229, 231, 180, 101/181, 182, 183, 184, 185, 409, 410, 411; 271/277, 82; 74/333, 352, 335, 355, 364

[56] References Cited

U.S. PATENT DOCUMENTS 3,699,887 10/1972 Southam et al. ..... 101/183

FOREIGN PATENT DOCUMENTS 1214436 12/1970 United Kingdom ..... 101/230

2080254 2/1982 United Kingdom ..... 101/230

*Primary Examiner*—J. Reed Fisher

*Attorney, Agent, or Firm*—Michael J. Striker

[57] ABSTRACT

A printing machine which has a plurality of printing units each including several rollers is equipped with a gear train which drives at least one roller of each of the printing units. At least associated two of the gear wheels of the gear train are coaxially mounted on a common shaft, one of them being movable toward and out of contact with the other gear wheel for establishing entraining connection therewith and for permitting angular displacement of the associated gear wheels relative to one another, respectively. The angular position of the associates gear wheels is to be changed when the mode of operation of the printing machine is to be changed from first page printing mode to first and second page printing mode. The arrangement which connects and disconnects the associated wheels includes a plurality of moving units which simultaneously act on the other gear wheel and which are mounted on an annular clamping element mounted on the other side of the one gear wheel from the one gear wheel. The moving unit may include a cylinder-and-piston unit having a toothed piston rod meshing with a pinion mounted on a threaded element meshingly received in a threaded bore of the other gear wheel, or an angular displacement motor having a threaded output shaft meshingly received in such threaded bore, or a cylinder-and-piston unit having a piston rod articulated to an eccentric disk rotatably mounted on a bearing block rigid with the other gear wheel.

13 Claims, 9 Drawing Figures

ARRANGEMENT FOR SELECTIVELY CONNECTING COAXIAL GEAR WHEELS OF A GEAR TRAIN OF A DUAL MODE PRINTING MACHINE

CROSS-REFERENCE TO RELATED APPLICATION

This application is a continuation-in-part application of our copending application Ser. No. 330,773, filed Dec. 14, 1981, now abandoned, and entitled DEVICE FOR THE DRIVE ADJUSTMENT IN BLANK PAPER AND COUNTERPRESSURE PRINTING MACHINES.

BACKGROUND OF THE INVENTION

The present invention relates to an arrangement for selectively connecting gear wheels mounted for rotation about a common axis and incorporated in a gear train in general, and more particularly to such an arrangement as used in a printing machine selectively operable in a first page printing mode and a first and second page printing mode.

In printing machines which are capable of operating in the first and second page printing mode, that is, in printing machines including a plurality of printing stations of which at least one prints on one side of the respective sheet while at least one other prints on the other side of the same sheet, it is conventional to so transfer the respective sheet from a preceding printing roller to a succeeding sheet transfer roller that the sheet is gripped at a tangential region at its then trailing edge portion. Then, the sheet is transferred on this sheet transfer roller to another gripping system to be thereafter transported with its previously trailing edge portion ahead. On the other hand, when it is desired to print images at consecutive printing stations only on one side of the sheet, the sheet is transferred at a corresponding tangential region from the previous printing roller to the sheet transfer roller in such a manner that it is gripped at its leading edge portion and then transported in this orientation. In order to render it possible for the suction devices or for the mechanical gripping devices of the sheet transfer roller of a printing machine which is convertible for operation either in the first page printing mode or in the first and second page printing mode to engage the respective sheet at its leading edge portion in one instance and at its trailing edge portion in the other instance, it is necessary to provide for the necessary positional or phase adjustment in the printing machine either upstream of or downstream of the sheet transfer roller.

In the German Democratic Republic patent No. 135,812, there is disclosed an arrangement in which the printing stations are driven by gear wheels which form a continuous gear train. The adjustment of the printing machine between the two above-discussed printing modes is rendered possible by the incorporation of a double gear wheel in the gear train. Herein, the double gear wheel is so constructed that a first of these gear wheels is rigidly connected with the respective cylinder or roller of the printing machine, while the other is pressed by a spring force against the first gear wheel, so that there is obtained a force-transmitting engagement between the two gear wheels which results in entrainment of the other gear wheel for joint rotation with the first gear wheel. This force-transmitting engagement can be terminated or temporarily discontinued when it is desired to change the relative angular position of the other gear wheel with respect to the first gear wheel by operating centrally operatable screws.

In the prior-art arrangement of this type, the adjustment of the drive is considerably improved as compared to the situation existing prior to this construction. Even planarly acting pressing forces are constantly reproducible after each adjustment of the drive. However, what is disadvantageous in this construction is that the lid or panel which completes the respective lateral wall must be removed before, and replaced after, each adjustment. A considerable time expenditure is involved in this quite laborious operation and, in addition thereto, the time needed for removing and replacing this paneling or cladding increases the idle time of the printing machine during the adjustment.

SUMMARY OF THE INVENTION

Accordingly, it is a general object of the present invention to avoid the disadvantages of the prior art.

More particularly, it is an object of the invention to develop an arrangement for selectively connecting and disconnecting coaxially mounted gear wheels of a gear train, particularly that of a printing machine, which is not possessed of the disadvantages of the conventional arrangements of this type.

It is still another object of the present invention to so construct the arrangement of the type here under consideration as to reduce the amount of idle time of the machine in which the coaxial gear wheels are being used by reducing the total time needed for performing the adjustment operation.

Yet another object of the present invention is to so design the arrangement of the above type as to be able to adjust the position of the coaxial gear wheels without having to gain access thereto by the removal of machine cladding panels.

It is a further object of the invention to give the arrangement such a construction as to be able to achieve uniform and reproducible pressing of the cooperating components of the arrangement against one another.

A concomitant object of the invention is to devise a coaxial gear wheel adjustably connecting arrangement which is simple in construction, inexpensive to manufacture, easy to operate, and reliable nevertheless.

In pursuance of these objects and others which will become apparent hereafter, one feature of the present invention resides in an arrangement for selectively connecting and disconnecting associated gear wheels of a gear train which are mounted for rotation about a common axis axially adjacent to one another and one of which is axially movable relative to the other, especially for use in a printing machine which includes a plurality of printing units having respective rollers commonly driven by the gear train and is selectively operatable in a first page printing mode and in a first and second page printing mode, the arrangement comprising, in essence, a clamping element mounted across the one gear wheel from the other gear wheel for axial movement toward and away from the one gear wheel; and hydraulically operatable moving means for axially moving the clamping element between a first position in which it establishes rotationally entraining connection between the associated gear wheels and a second position in which it permits relative angular displacement about the common axis between the associated gear wheels. Advantageously, the associated gear wheels and the clamping element have associated mutually facing contact surfaces, and the moving means is operative for moving the one gear wheel and the clamping element relative to the other gear wheel into the first position in which the associated contact surfaces are in contact with one another to clamp the one gear between the clamping element and the other gear wheel. The clamping element advantageously has an annular configuration.

In accordance with one advantageous aspect of the present invention, the moving means includes a plurality of internally threaded bores in the other gear wheel, a plurality of threaded elements each partially meshingly received in one of the threaded bores, a plurality of pinions each mounted on one of the threaded elements for joint rotation therewith and situated at the opposite side of the clamping element from the one gear wheel, and a plurality of cylinder-and-piston units each having a housing rigidly mounted on the clamping element at the other side thereof and a piston rod having a free end portion extending out of the housing and having a row of teeth meshing with an associated one of the pinions.

In another advantageous version of the moving means of the present invention, the other gear wheel has a plurality of internally threaded bores each of which meshingly receives an externally threaded output shaft of an associated one of a plurality of angular displacement motors whose housings are rigidly mounted on the clamping element.

Rather than being constructed in the above-discussed manners, the moving means may advantageously include a plurality of bearing blocks each of which is rigidly connected with the other gear wheel and is situated at the other side of the clamping element from the one gear wheel, a plurality of eccentric discs each mounted on one of the bearing blocks for rotation, and a plurality of cylinder-and-piston units each having a housing articulately connected to the clamping element and a piston rod extending out of the housing and articulately connected to the associated one of the eccentric discs.

The associated gears are advantageously mounted on a shaft for rotation about the common axis. Then, the moving means advantageously includes a plurality of moving devices mounted on the clamping element and acting on the other gear wheel, and a pressure oil distributor mounted on the shaft and hydraulically connected to the moving devices. It is further advantageous in this connection when the moving means further includes a directional switching valve and a pressure limiting valve arranged upstream of the distributor.

According to an advantageous facet of the present invention which finds particularly advantageous use in connection with the first-described construction of the moving means, there is further provided means for indicating the condition of the gear wheel connection, this indicating means including a plurality of stationarily mounted proximity indicators operative for indicating the positions of associated movable parts of the arrangement. The movable parts are advantageously constituted by abutments provided on the piston rods of the cylinder-and-piston units which constitute the moving means. It is particularly advantageous when at least some of the proximity indicators are electrically connected in series with one another. In a particularly advantageous construction embodying this apsect of the present invention, the proximity indicators include a first kind of proximity indicator which is operative for indicating the assumption of the first position, a second kind of proximity indicator which is operative for indicating the assumption of the second position, and a third kind of proximity indicator which is operative for indicating the interruption of the effective chain.

The novel features which are considered as characteristic of the invention are set forth in particular in the appended claims. The improved arrangement for selectively connecting coaxially mounted gears of a gear train itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
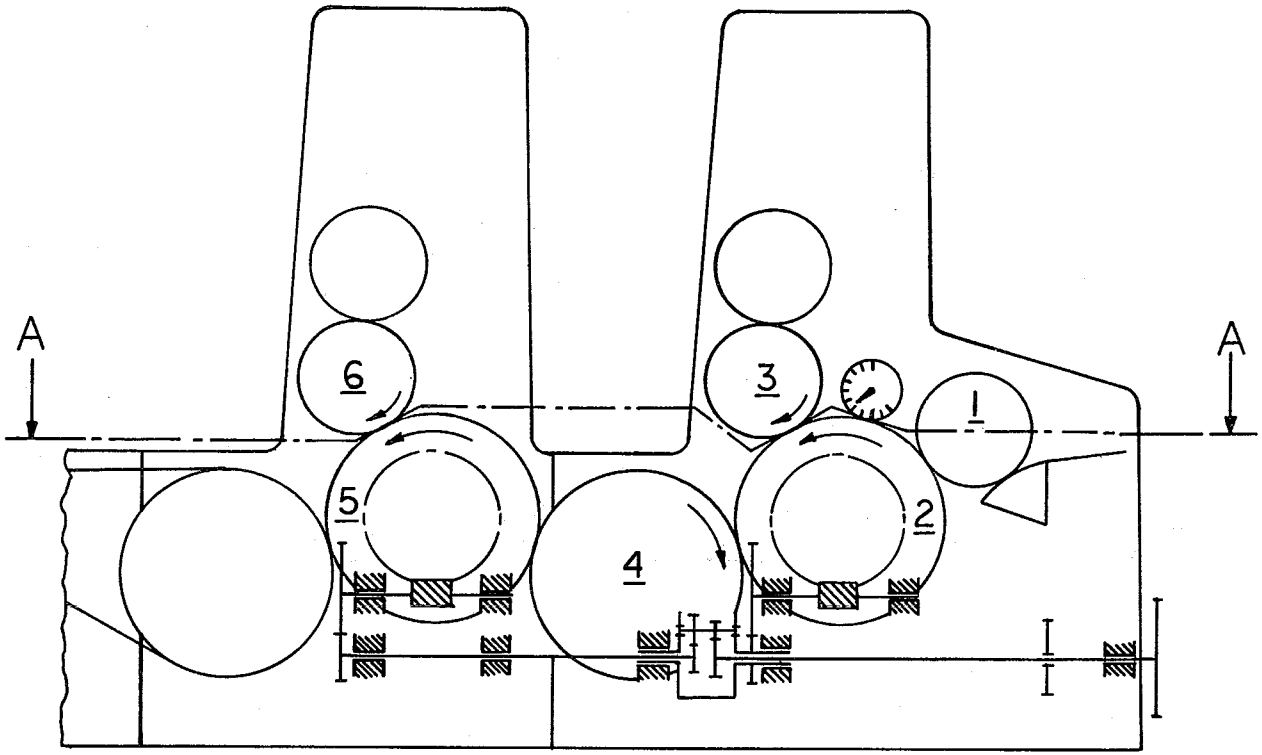
FIG. 1 is a diagrammatic side elevational view of a two-color offset printing machine which is to be equipped with a selectively connecting arrangement according to the present invention.

Referring now to the drawing in detail, and first to FIG. 1 thereof, it may be seen that the reference numerals 1 to 6 identify various cylinders or rollers of a printing machine or press, that is, a feeding roller 1, a printing roller 2, a rubber roller 3, a sheet transfer roller 4, another printing roller 5, and another rubber roller 6.

The operation of the rollers 1 to 6 and their cooperation with one another and with other components of the printing machine are so well known that many of the components cooperating with the rollers 1 to 6 have been omitted from the drawing in order not to unduly encumber the same, and that they need not be discussed here in any great detail. Suffice it to say that the printing machine is of the type which is capable of operation in two modes in one of which both printing rollers 2 and 5 print on the same side of the respective sheet (herein referred-to as first page printing), and in the other of which the printing roller 2 prints on one side and the other printing roller 5 prints on the other side (herein referred-to as first and second page printing).

In both modes of operation, the sheet to be printed on is transferred from the feeding roller 1 to the printing roller 2 and the printing ink image is transferred to the first page thereof between the printing roller 2 and the rubber roller 3. Then, the further progress of the sheet is different for each mode of operation.

When operating in the first mode in which the successive printings are first page printings, the sheet is so transferred to the transfer roller 4 that its previously leading edge portion again comes first as considered in the direction of further travel of the sheet. The transfer roller 4 advances the sheet in the predetermined path toward the other printing roller 5 and then the sheet is transferred to the other printing roller 5 to be printed on at the same page as before between the printing roller 5 and the rubber roller 6. All transfers of the sheet between the individual rollers, 1, 2, 4, and 5 are accomplished in a conventional manner which has not been illustrated and which will only be referred to here when necessary for understanding the invention. Suffice it to say that the transfer of the sheets and the advancement of the latter with the respective rollers 1, 2, 4 and 5 can be accomplished by conventional mechanical grippers or by suction-type grippers. The printing on the other printing roller 5 when operating in the first mode may be, for instance, in a different color than on the first printing roller 2. Once the printing on the other printing roller 5 is accomplished, the sheet is transferred, again in a conventional manner, either to a subsequent printing station, or to a collecting device.

When the printing is to take place in the second mode in which the printing is to take place on the first page on the first printing roller 2 and on the second page on the second printing roller 5, the sheet is retained on the first printing roller 2 after the first printing for so long, until the then trailing edge portion can be and is gripped at a tangential region or nip by the non-illustrated gripping arrangement of the transfer roller 4, such as a suction-type gripping arrangement. During the further rotation of the rollers 1 to 5, the suction elements and the mechanical grippers associated therewith are pivoted into the roller interior and the heretofore trailing edge portion is transferred to the following grippers. The sheet is now fed into the next printing region with its previously trailing edge portion first, to be printed on on the second page.

The change-over between the first and second mode of operation necessitates an angular change in the position of the printing cylinder or roller 2. Simultaneously with the change in the angular position of the printing roller 2, there is to take place a relative adjustment of the positions of all rollers and driving components of the upstream part of the machine with respect to the positions of all rollers and driving components of the downstream part of the machine.

Figure 2:
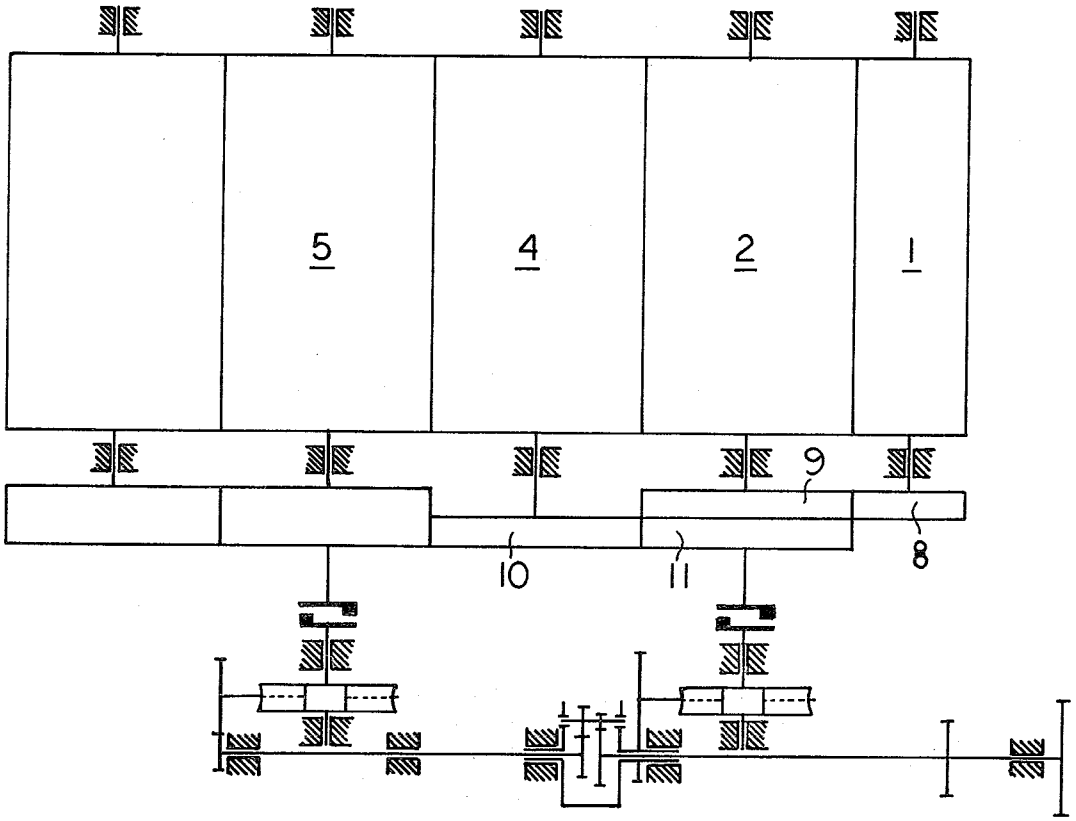
FIG. 2 is a sectional view taken on line A—A of FIG. 1.

As a comparison of FIG. 1 with FIG. 2 will show, for the positional adjustment or change of the drive, there is mounted on a stub shaft 7 of the printing cylinder 2 a gear wheel 9 which meshes with a gear wheel 8 of the feeding roller 1. A gear wheel 11 which meshes with a gear wheel 10 of the sheet transfer roller 4 is mounted on the gear wheel 9. As shown in particular in FIG. 3, the gear wheels 9 and 11 can be connected to one another for joint rotation with each other via a ring 12 and by means of hydraulically operated entraining devices 13.

Figure 3:
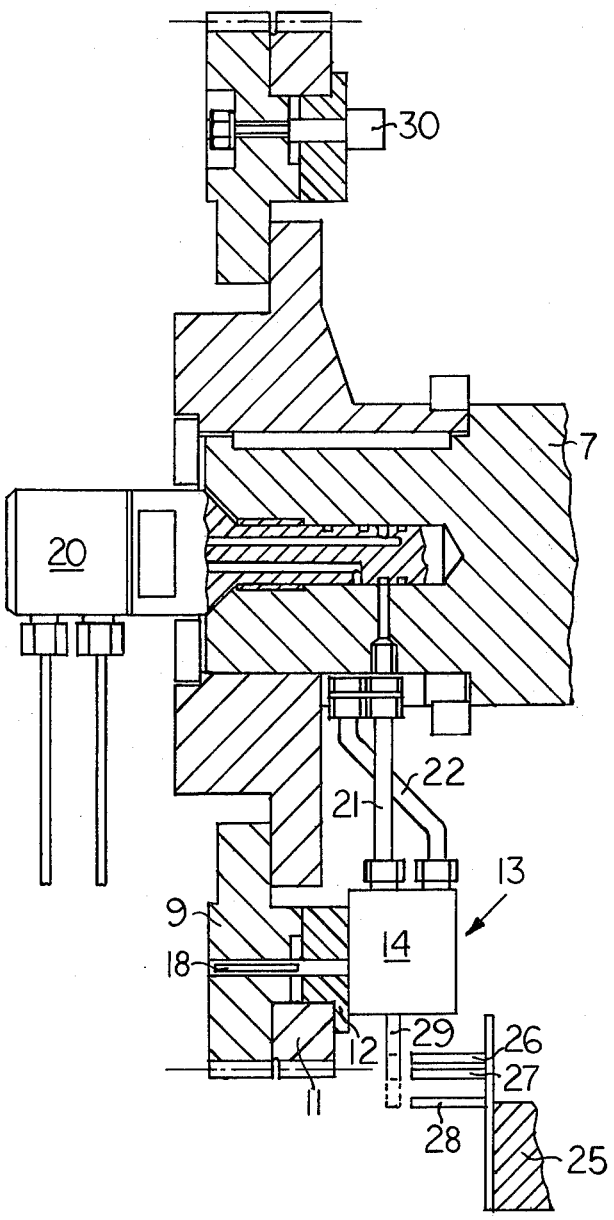
FIG. 3 is a partially sectioned view of the arrangement of the present invention and of a shaft on which it is mounted.
Figure 4:
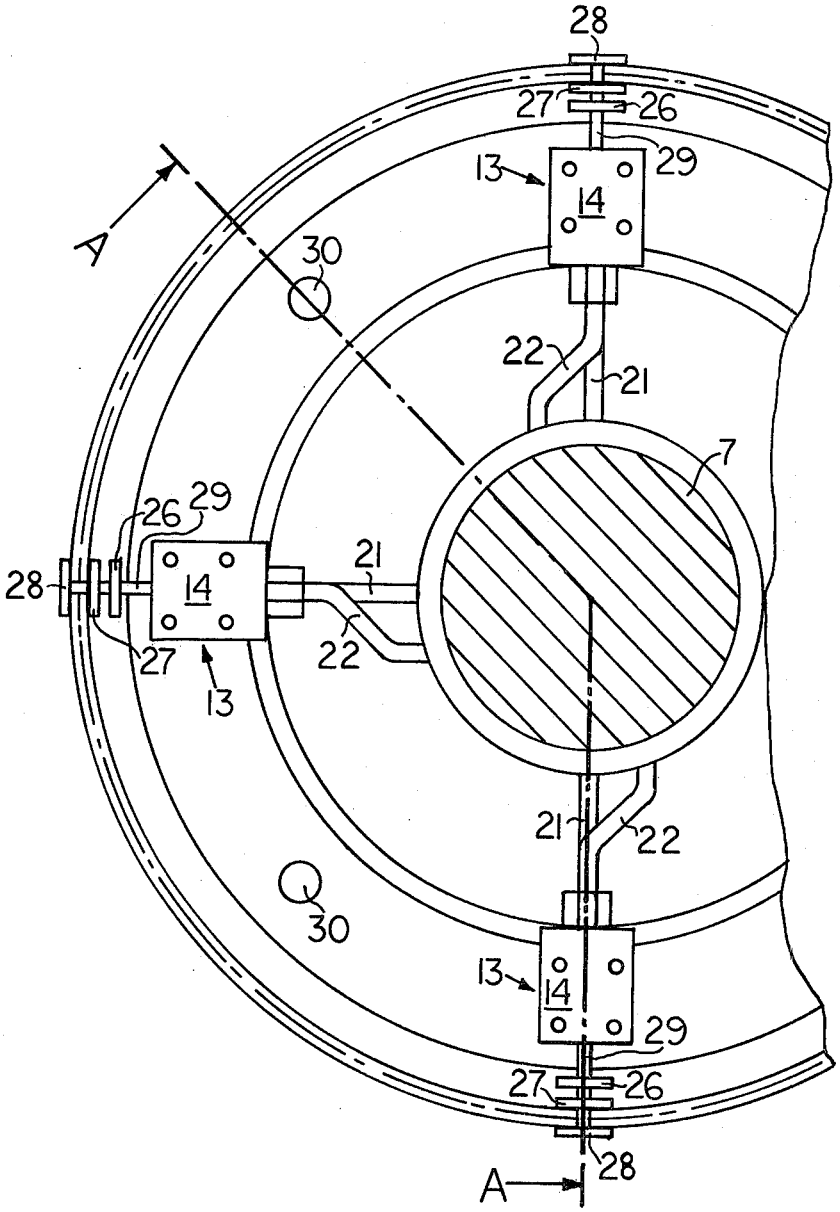
FIG. 4 is a fragmentary axial end view of the arrangement of FIG. 3.
Figure 5:
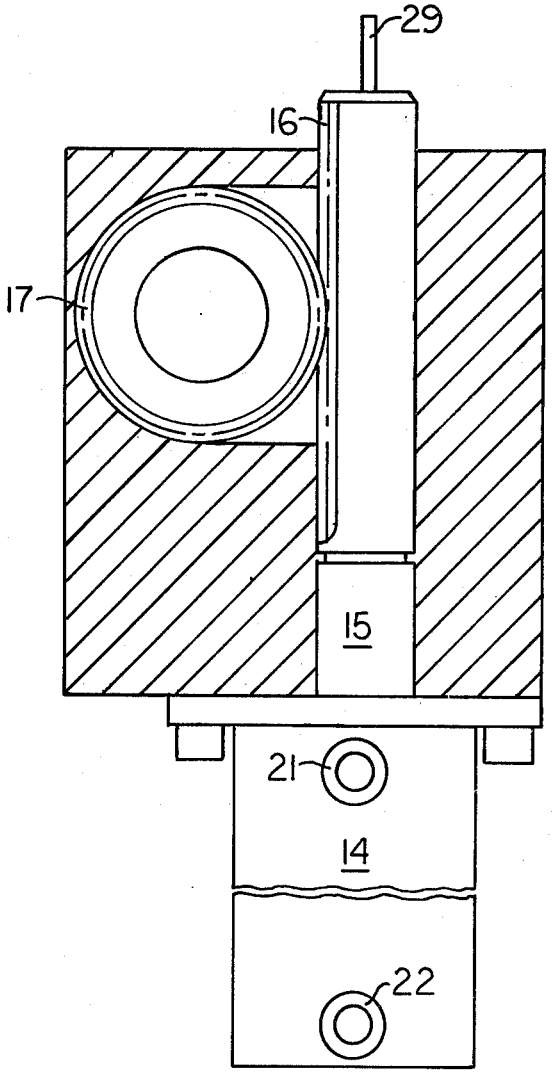
FIG. 5 is a partially sectioned view of an operative portion of the arrangement of the present invention as shown in FIG. 3.

In a first construction according to the present invention, which is illustrated in FIGS. 3, 4 and 5, there is provided a plurality, such as four, of the entraining devices 13, of which each includes a hydraulically operatable cylinder-and-piston unit 14 which includes a piston rod 15 that emerges from the housing of the unit 14 at one axial end of the latter. The piston rod 15 is provided with a toothed end portion 16 which meshes with gears 17 (see FIG. 5). Each of the gears 17 is rigidly connected with one threaded bolt or spindle 18. As shown in FIG. 3, the threaded bolts 18 are received in internally threaded bores 19 of the gear wheel 9 in engagement with the thread of the respective bore 19. In response to the rotation thereof in one direction, the threaded bolts 18 accomplish clamping of the gear wheel 11 between the gear wheel 9 and the ring 12.

As may be most clearly seen in FIG. 3, pressure oil which is needed for the actuation of the cylinder-and-piston units 14 is supplied through a pressure oil distributor 20, which is threadingly connected to the stub shaft 7 of the printing roller 2, and through respective pipes or conduits 21 and 22. For the tightening movement of the threaded bolts or spindles 18, the pressure oil is supplied through the conduits 21 to that side of the cylinder-and-piston unit 14 at which the piston rod 15 is situated. For the releasing movement of the threaded spindles or bolts 18, the pressure oil is supplied via the conduit 22 to that side of the cylinder-and-piston unit 14 at which there is no piston rod. By resorting to this measure, it is achieved, in the simplest possible manner, that a greater torque is available for loosening the threaded bolts 18 than for tightening the same, due to the difference between the effective surface areas of the piston of the cylinder-and-piston unit 14. Of course, as the pressure oil is supplied to one side of the unit 14, the pressure at the other side is relieved.

Figure 9:
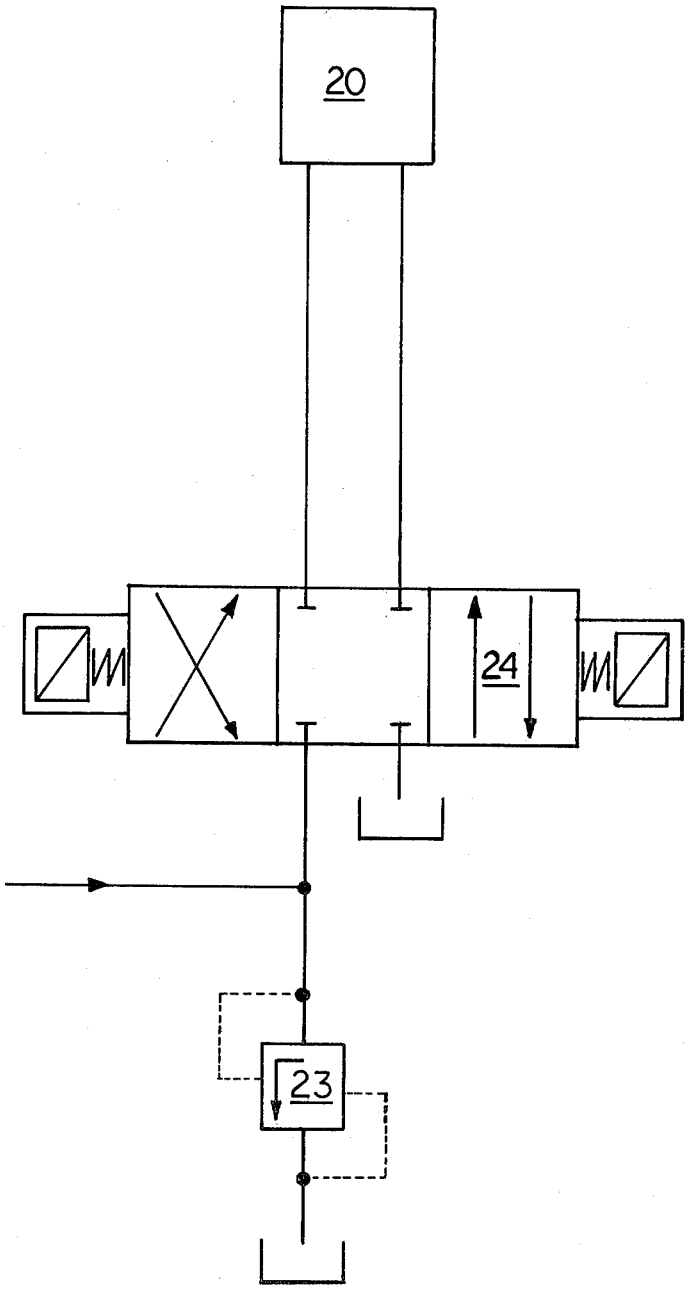
FIG. 9 is a diagrammatic representation of a part of a hydraulic circuit for supplying pressurized hydraulic fluid to the arrangement of the present invention.

The torque needed for the tightening of the threaded bolt 18 is obtained by adjusting the pressure of the pressure oil supplied to the pressure oil distributor 20. This pressure selection is accomplished in a pressure control arrangement which is illustrated in FIG. 9 and which is situated upstream of the pressure oil distributor 20. This pressure control arrangement includes a pressure limiting valve 23 which is combined with a pressure reducing valve and which is operative for adjusting the pressure which is needed for operation. Pressurized oil is supplied to the pressure limiting valve from the oil-supply arrangement of the machine. A magnetically actuated directional valve 24 is arranged downstream of the pressure limiting valve 23. The directional valve 24 accomplishes the distribution of the pressure oil emerging from the pressure limiting valve 23 to the conduits 21 and 22 and thus to the one or the other side of the cylinder-and-piston unit 14.

For the supervision of the state of condition of the connection of the gear wheels 9 and 11 with one another, there are mounted on a lateral wall 25 of the machine respective proximity indicators 26, 27 and 28 (see particularly FIG. 3). These proximity indicators 26, 27, and 28 respectively cooperate with sensing pins 29 which are mounted on the piston rods 15 that emerge out of the housings of the cylinder-and-piston units 14. The proximity indicators 26 are activated when the threaded bolts 18 are loosened, while the proximity indicators 27 are activated when the threaded bolts 18 are fully tightened. When the effective chain is interrupted, such as when one of the threaded bolts is broken, then the proximity indicator 28 is effective. The proximity indicators 26, 27 and 28 are associated with each of the cylinder-and-piston units 14. The proximity indicators 26, 27, and 28 associated with the units 14 are respectively connected in series with one another. In this manner, any irregularity in operation is indicated immediately upon occurrence. In order to keep the lateral play of the gear wheel 11 in the loosened condition of the threaded bolts or spindles 18 within acceptable limits, there are provided distancing screws 30 between the respectively circumferentially adjacent cylinder-and-piston units 14. The distancing screws 30 are distributed over the circumference of the gear wheel 9, being threadingly connected with the latter, and guiding the ring 12 with a small lateral play.

When the pressure oil is admitted into the cylinder-and-piston units 14, the respective piston rods 15 will rotate the associated gears 17 and thus also the associated threaded bolts 18. As a result of the rotation of the threaded bolts 18, the gear wheel 11 is clamped between the gear wheel 9 and the ring 12 on rotation of the threaded bolts 18 in one sense, which results from the admission of the pressure oil to one side of the piston of each of the cylinder-and-piston units 14. On the other hand, the admission of the pressure oil to the other side of the pistons of the cylinder-and-piston units 14 results in rotation of the threaded bolts 18 in the opposite sense and thus in the discontinuation of this clamping action.

Figure 6:
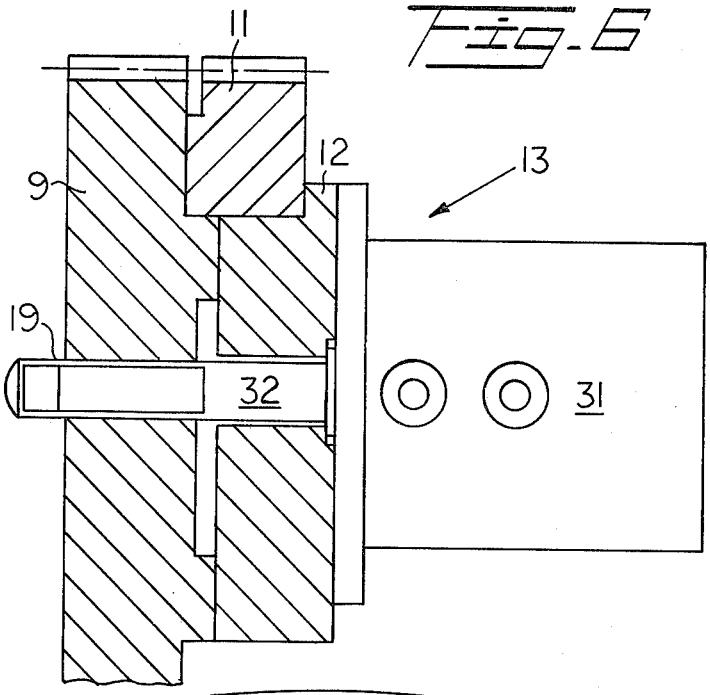
FIG. 6 is a view similar to that of FIG. 5 but of a modified version of the arrangement of the present invention.

Turning now to FIG. 6 of the drawing, it may be seen that it shows a modified version of the arrangement of the present invention in which, because of the similarities in the basic construction, the same reference numerals have been used to identify the same or corresponding components. In this construction, four angular displacement motors 31, which are of the type in which the angle of rotation of the respective output shaft 32 can be selected at will, are mounted on the ring 12. The output shaft 32 of each of the angular displacement motors 31 is provided at its protruding end with a thread which extends into and meshes with the thread of the respectively associated threaded bore 19 of the gear wheel 9.

When the pressure oil is so admitted into the angular displacement motors 31 as to rotate the output shafts 32 thereof in one sense, the meshing engagement of the threads of the output shafts 32 with the internal threads of the respective threaded bores 19 results in displacement of the gear wheel 9 relative to the ring 12, and thus in clamping of the gear wheel 11 between the gear wheel 9 and the ring 12. Conversely, such admission of the pressure oil to the angular displacement motors 31 as to rotate the output shafts 32 thereof in the opposite sense results in the discontinuation of the clamping action. The construction of the angular displacement motors 31 is conventional, so that it need not be discussed here in detail, except for mentioning that such motors 31 are preferably of the hydraulically operated type.

Figure 7:
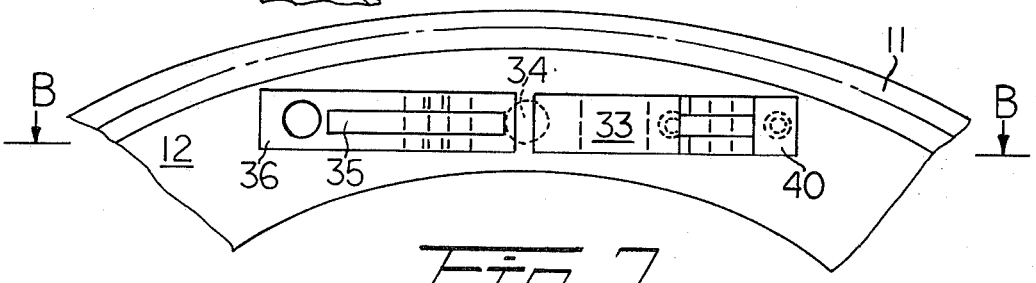
FIG. 7 is an axial end view of a further modification of the arrangement of the present invention.
Figure 8:
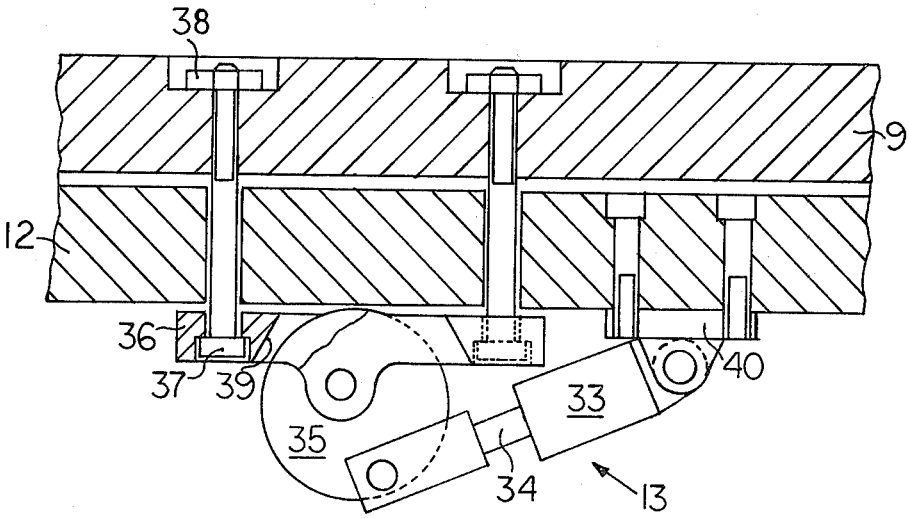
FIG. 8 is a sectional view taken on line B—B of FIG. 7.

In a further modified version of the arrangement of the present invention, which is shown in FIGS. 7 and 8, and in which again the basic construction is so similar to that described above that the same reference numerals have been used for the corresponding components and that no additional description of this basic construction is needed, four cylinder-and-piston units 33 are articulately connected to the ring 12. A piston rod 34 of each of the cylinder-and-piston units 33 is pivotally connected with an associated eccentric disc 35. Each of the eccentric discs 35 is mounted on an associated bearing block 36 for rotation about the respective axis thereof. The bearing blocks 36 are threadedly connected with the gear wheel 9. The threaded connection of the bearing blocks 36 is such that respective screws 37 pass through passages or through bores of the ring 12 and are threaded into threaded bores of the gear wheel 9. A small clearance which is needed for the adjustment of the position of the gear wheel 11 is adjusted by means of the screws 37. After this adjustment has been accomplished, the screws 37 are secured in their then assumed angular positions by jam or lock nuts 38. Each of the bearing blocks 36 is provided with a slot 39 in which the respective eccentric disc 35 is partially received. The cylinder-and-piston units 33 are articulately connected to respective bearing blocks 40 which are secured to the ring 12. When the pressure oil is admitted to one side of the pistons of the cylinder-and-piston units 33, the respective piston rods 34 rotate the associated eccentric discs 35 to thereby bring about the clamping action of the ring 12 and of the gear wheel 9 on the gear wheel 11. When the pressure oil is admitted to the other side of the pistons of the cylinder-and-piston units 33, the eccentric discs 35 are turned in the opposite sense, so that the clamping action is discontinued.

As a result of the use of the hydraulically operated adjustment devices or members 13, it is possible to accomplish the adjustment of the position of the drive, without having to remove the machine cladding or paneling. It is also advantageous that the dissociation as well as the clamping of the gear wheels 9 and 11 occurs simultaneously and in each case with the same clamping force.

It will be understood that each of the elements described above, or two or more together, may also find a useful application in other types of arrangements differing from the type described above.

While the invention has been illustrated and described as embodied in an adjusting arrangement for a printing machine or press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

We claim:

1. An arrangement for selectively connecting and disconnecting two associated gear wheels of a gear train which are rotatable about a common axis axially adjacent to one another and axially movable relative to each other, especially for use in a printing machine which includes a plurality of printing units having respective rollers commonly driven by the gear train and which is selectively operatable in a first page printing mode and in a first and second page printing mode, said arrangement comprising a clamping element having at least a portion situated at an opposite axial side of one of the two associated gear wheels from the other of the two associated gear wheels and axially movable toward and away from the one gear wheel; and hydraulically operatable moving means for axially moving said clamping element between a first position in which it axially displaces the two associated gear wheels toward one another and presses the same axially against each other to establish rotationally entraining connection between the two associated gear wheels, and a second position in which it permits the two associated gear wheels to move axially away from each other to terminate the rotationally entraining connection and thus to release the two associated gear wheels for relative angular displacement about the common axis.

2. The arrangement as defined in claim 1, wherein the two associated gear wheels and said portion of said clamping element have associated mutually facing contact surfaces; and wherein said moving means is operative for moving said clamping element and the one gear wheel relative to the other gear wheel into said first position in which said associated contact surfaces are respectively in contact with one another to clamp the one gear wheel between said portion of said clamping element and the other gear wheel.

3. The arrangement as defined in claim 1, wherein said clamping element has an annular configuration.

4. The arrangement as defined in claim 1, wherein said moving means includes a plurality of internally threaded bores in the other gear wheel, a plurality of threaded elements each partially meshingly received in one of said threaded bores, a plurality of pinions each mounted on one of said threaded elements for joint rotation therewith and situated at the opposite side of said clamping element from the one gear wheel, and a plurality of cylinder-and-piston units each having a housing rigidly mounted on said clamping element at said other side thereof and a piston rod having a free end portion extending out of said housing and having a row of teeth meshing with an associated one of said pinions.

5. The arrangement as defined in claim 1, wherein said moving means includes a plurality of internally threaded bores in the other gear wheel, and a plurality of angular displacement motors each having a housing rigidly mounted on said clamping element and an externally threaded output shaft meshingly received in an associated one of said threaded bores.

6. The arrangement as defined in claim 1, wherein said moving means includes a plurality of bearing blocks each rigidly connected with the other gear wheel and situated at the other side of said clamping element from the one gear wheel, a plurality of eccentric discs each mounted on one of said bearing blocks for rotation, and a plurality of cylinder-and-piston units each having a housing articulately connected to said clamping element and a piston rod extending out of said housing and articulately connected to the associated one of said eccentric discs.

7. The arrangement as defined in claim 1; further comprising means for mounting the gear wheels for rotation about the common axis, including a shaft; and wherein said moving means includes a plurality of moving devices mounted on said clamping element and acting on the other gear wheel, and a pressure oil distributor mounted on said shaft and hydraulically connected to said moving devices.

8. The arrangement as defined in claim 7, wherein said moving means further includes a directional valve and a pressure limiting valve arranged upstream of and hydraulically connected to said distributor.

9. The arrangement as defined in claim 1; and further comprising means for indicating the condition of the gear wheel connection, comprising a plurality of stationarily mounted proximity indicators operative for indicating the position of associated movable parts of the arrangement.

10. The arrangement as defined in claim 9, wherein said moving means includes a plurality of cylinder-and-piston units each having a piston rod including at least one abutment; and wherein said abutments on said piston rods constitute said movable parts.

11. The arrangement as defined in claim 10, wherein at least some of said proximity indicators are electrically connected in series with one another.

12. The arrangement as defined in claim 9, wherein said proximity indicators include a first kind of proximity indicator which is operative for indicating the assumption of said first position, and a second kind of proximity indicator which is operative for indicating the assumption of said second position.

13. The arrangement as defined in claim 12, wherein said proximity indicators further include a third kind of proximity indicator which is operative for indicating the inoperativeness of the respective unit.

* * * * *